US010622746B2

(12) United States Patent
Abraham et al.

(10) Patent No.: US 10,622,746 B2
(45) Date of Patent: Apr. 14, 2020

(54) TERMINAL POSITION ASSURANCE MEMBER AND METHOD OF OPERATING A TERMINAL POSITION ASSURANCE MEMBER

(71) Applicant: J.S.T. CORPORATION, Farmington Hills, MI (US)

(72) Inventors: Rajit Abraham, Shelby Township, MI (US); Franklin A. Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/405,405

(22) Filed: Jan. 13, 2017

(65) Prior Publication Data

US 2017/0207578 A1 Jul. 20, 2017

Related U.S. Application Data

(60) Provisional application No. 62/279,109, filed on Jan. 15, 2016.

(51) Int. Cl.
*H01R 13/40* (2006.01)
*H01R 13/436* (2006.01)
*H01R 107/00* (2006.01)

(52) U.S. Cl.
CPC ..... *H01R 13/4362* (2013.01); *H01R 13/4361* (2013.01); *H01R 2107/00* (2013.01)

(58) Field of Classification Search
CPC ..... H01R 13/6272; H01R 13/6275; H01R 13/4223; H01R 13/4362
USPC ..... 439/352–354, 595, 752, 752.5
See application file for complete search history.

(56) References Cited

U.S. PATENT DOCUMENTS 4,946,398 A * 8/1990 Takenouchi ..... H01R 13/4368 439/595
5,004,436 A * 4/1991 Aoyama ..... H01R 13/4368 439/595
5,145,419 A * 9/1992 Yamanashi ..... H01R 13/4368 439/595
5,224,883 A * 7/1993 Yamamoto ..... H01R 13/4368 439/595

(Continued)

FOREIGN PATENT DOCUMENTS

EP 0828318 A2 3/1998
EP 3046185 A 7/2016

(Continued)

OTHER PUBLICATIONS

U.S. PTO Office Action in U.S. Appl. No. 15/405,654, dated Jun. 29, 2017.

(Continued)

*Primary Examiner* — Thanh Tam T Le
(74) *Attorney, Agent, or Firm* — Kratz, Quintos & Hanson, LLP

(57) ABSTRACT

Terminal position assurance (TPA) member used in a connector, to make sure that a terminal is positioned properly. The TPA member has at least one locating/guide feature to provide proper guidance and to avoid an imbalance during engagement with a connector housing, and has at least one flexible feature to help retain the TPA member in a preset position and/or a final lock position.

23 Claims, 8 Drawing Sheets

(56) References Cited

U.S. PATENT DOCUMENTS 5,252,096 A * 10/1993 Okada ..... H01R 13/4362 439/752
5,358,427 A * 10/1994 Miwa ..... H01R 13/4362 439/595
5,507,666 A 4/1996 Yamanashi
5,516,308 A 5/1996 Yamanashi
5,782,657 A * 7/1998 Wolla ..... H01R 13/4362 439/595
5,830,013 A 11/1998 Saito
5,839,915 A 11/1998 Ford
5,848,919 A * 12/1998 Nagano ..... H01R 13/4362 439/752
5,928,038 A 7/1999 Berg
5,934,946 A 8/1999 Nakamura
6,010,374 A * 1/2000 Miwa ..... H01R 13/4362 439/752
6,036,552 A 3/2000 Atsumi
6,068,507 A 5/2000 Popa
6,135,802 A 10/2000 Nakamura
6,171,150 B1 1/2001 Saito
6,261,116 B1 7/2001 Ceru
6,296,531 B1 10/2001 Nagamine
6,390,859 B2 * 5/2002 Furutani ..... H01R 13/4362 439/752
6,464,544 B1 10/2002 Yamamoto
6,527,583 B2 3/2003 Plate
6,648,699 B1 * 11/2003 Makino ..... H01R 13/4362 439/595
6,655,999 B2 12/2003 Mase
6,702,626 B2 3/2004 Ichio
6,780,045 B2 8/2004 Shuey
6,902,443 B2 * 6/2005 Hara ..... H01R 13/4362 439/752
7,114,992 B2 * 10/2006 Sagawa ..... H01R 13/4365 439/595
7,182,652 B2 2/2007 Yamakada
7,195,522 B2 * 3/2007 Okada ..... H01R 13/4362 439/752
7,278,890 B1 * 10/2007 Smutny ..... H01R 13/4361 439/752
7,347,745 B1 3/2008 Raudenbush
7,500,887 B2 * 3/2009 Ichio ..... H01R 13/4362 439/595
7,544,081 B2 6/2009 Lim
7,556,539 B2 * 7/2009 Takahashi ..... H01R 13/4362 439/752
8,075,351 B2 12/2011 Park
8,096,841 B2 1/2012 Hirano
8,277,243 B1 10/2012 Hernandez
8,641,458 B2 2/2014 Matsumura
8,747,146 B2 6/2014 Brown
8,951,066 B2 * 2/2015 Glick ..... H01R 13/426 439/595
9,017,108 B2 * 4/2015 Suemitsu ..... H01R 13/4223 439/595
9,039,462 B2 * 5/2015 Yoon ..... H01R 13/62 439/752
9,048,563 B2 * 6/2015 Miura ..... H01R 12/81
9,160,095 B2 10/2015 Littek
9,318,847 B2 * 4/2016 Endo ..... H01R 13/639
2017/0179643 A1 6/2017 Golub
2017/0207575 A1 7/2017 Jabrane
2017/0207577 A1 7/2017 Holub
2017/0207594 A1 7/2017 Jabrane

FOREIGN PATENT DOCUMENTS

GB 2255864 A 11/1992
JP 2004-327370 A 11/2004
JP 2005-166611 A 6/2005
JP 2009-043519 A 2/2009
JP 2016-062792 A 4/2016

OTHER PUBLICATIONS

U.S. PTO Office Action in U.S. Appl. No. 15/405,654, dated Jan. 25, 2018.
U.S. PTO Office Action in U.S. Appl. No. 15/407,562, dated Jun. 9, 2017.
U.S. PTO Office Action in U.S. Appl. No. 15/407,562, dated Mar. 8, 2018.
Extended European Search Report in European Application Serial No. 17207724.0, dated Mar. 29, 2018.
Extended European Search Report in European Application Serial No. 17207725.7, dated Mar. 29, 2018.
European Search Report in European Application Serial No. 17207739.8, dated Mar. 29, 2018.
European Search Report in European Application Serial No. 17207747.1, dated Mar. 29, 2018.
U.S. PTO Office Action in U.S. Appl. No. 15/407,562, dated Oct. 20, 2017.
Office Action in counterpart Japanese Application No. 2017-237653, dated Nov. 6, 2018, including English translation (6 pages).
Office Action of Japanese Patent Application No. 2017-237653: Notification of Reason for Refusal dated Mar. 14, 2019 (3 pages, 2 pages translation, 5 pages total).

* cited by examiner

TERMINAL POSITION ASSURANCE MEMBER AND METHOD OF OPERATING A TERMINAL POSITION ASSURANCE MEMBER

CROSS-REFERENCE TO RELATED APPLICATIONS

This patent application claims priority to U.S. Provisional Patent Application No. 62/279,109, filed Jan. 15, 2016, it is hereby incorporated herein by reference in its entirety.

BACKGROUND OF THE INVENTION

The present invention generally relates to a terminal position assurance (TPA) member used in a connector.

BRIEF SUMMARY OF THE INVENTION

The present invention generally relates to a terminal position assurance (TPA) member used in a connector. A TPA member can be used in a connector to make sure that a terminal is positioned properly. The connector can be an electrical connector or other type of connector, for example. The connector can have one or more terminals for electrical connections or for other types of connections, for example.

According to the principles of the present invention, a first TPA member has at least one flexible feature.

According to the principles of the present invention, a second TPA member has at least one locating/guide feature and at least one flexible feature. The locating/guide feature can also be referred to as a guide feature or a guide. The flexible feature can also be referred to as a protrusion.

According to the principles of the present invention, a second TPA member has at least one locating/guide feature to provide proper guidance and to avoid any imbalance created during engagement and disengagement with a connector or a connector housing.

A TPA member, according to the principles of the present invention, provides a number of desirable characteristics, including at least, for example: it helps to achieve a full potential force of the system and desirable audible "click" sound when TPA member is inserted into connector housing; it helps to avoid a TPA member being moved to a final lock position (or "set" position) during shipping and/or handling; it requires no secondary operation of a user; and it helps prevent failure.

It is a desirable trait to achieve full potential force of the system and an audible "click" sound. For example, when the TPA member is inserted into a connector housing, it is a desirable trait to achieve a full potential force of the system and to have an audible "click" sound for convenient assurance that the components are completely mated. In the automotive connector field and other fields, for example, an extra loud sound is favorable. It is desirable to have the loudest "click" sound possible. The "click" sound can be achieved by an interaction of latching features, for example.

Because of the use of location/guide features of the present invention, the TPA member's first pair of flexible features is more likely to engage substantially simultaneously, and then subsequently the TPA member's second pair of flexible features is more likely to engage substantially simultaneously, thereby achieving full potential force of the system and producing an audible "click" sound. Because of the location/guide features, there is additional force when a TPA member and a connector housing are mated together, and that additional force helps to make the "click" sound louder than it would have been if the location/guide features were not present.

It is a desirable trait to avoid a TPA member being moved to a final lock position (or "set" position) during shipping and/or handling. The location/guide features and flexible features of TPA members, according to the principles disclosed herein, help to make the TPA member more resistant to entering a final lock position (or "set" position) during shipping and/or handling. The location/guide features and flexible features of TPA members, according to the principles disclosed herein, help to prevent a movement of TPA members from a pre-set position to a final lock position during shipping and/or handling.

It is a desirable trait for a TPA member to avoid a need for a secondary operation of a user. The location/guide features and flexible features of TPA members, according to the principles disclosed herein, help to avoid a need for a secondary operation of a user. The desired movement can be accomplished by a single operation of a user.

It is a desirable trait for a TPA member to help prevent failure. The location/guide features and flexible features of TPA members, according to the principles disclosed herein, help to avoid failure.

When a TPA member and a connector housing are engaged together in a final lock position, the engagement thereof is assured because there is an audible "click" sound.

Additional features, advantages, and embodiments of the invention are set forth or are apparent from consideration of the following detailed description, drawings and claims. Moreover, it is to be understood that both the foregoing summary of the invention and the following detailed description are exemplary and are intended to provide further explanation without limiting the scope of the invention as claimed.

DETAILED DESCRIPTION OF THE PREFERRED EMBODIMENTS

There is a need to provide a TPA member with a configuration that helps to prevent inadvertent movement from a preset position to a final lock position.

For example, a TPA member can be partially inserted into a connector before shipping, and that position can correspond to a preset position. Then the connector, having the TPA in the preset position, can be shipped to a customer. At that time, the customer can put the connector to use, and then can lastly move the TPA member from the preset position to the final lock position. The customer typically does not want to receive a connector with a TPA member already in the final lock position, because this could mean that the customer needs to take one or more additional steps which would be inconvenient and not desirable. For example, the customer will need to move the TPA member from the final lock position to the preset position, then put the connector to use, and then move the TPA member from the preset position to the final lock position. Additional steps, or secondary operations, are not desired.

Thus, in view of the above, there is a need to provide a TPA member with a configuration that helps to prevent inadvertent movement from a preset position to a final lock position, during shipping and/or handling, for example.

Figure 1:
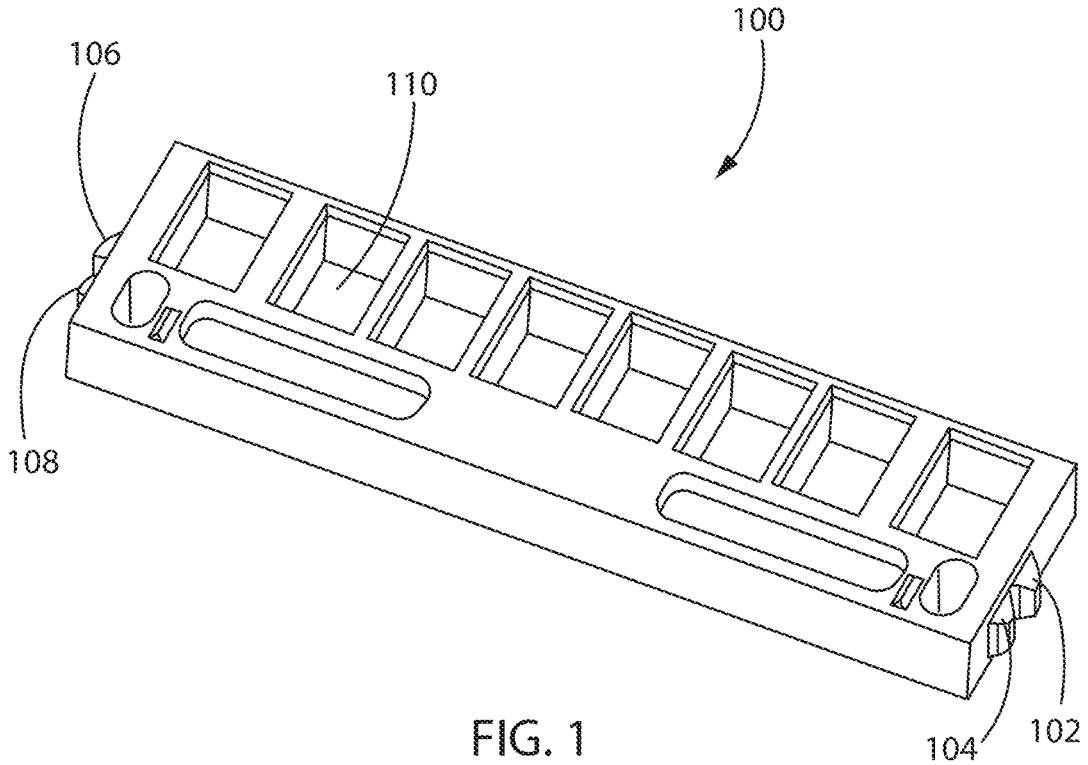
FIG. 1 is a perspective view of a first TPA member that has flexible features, in accordance with the principles of the present invention.

FIG. 1 is a perspective view of a first TPA member that has flexible features, in accordance with the principles of the present invention.

FIG. 1 illustrates a first TPA member, generally referred to by reference numeral 100. The first TPA member 100 has a body that has a first side which includes flexible feature 102 and flexible feature 104. The body of the first TPA member 100 has a second side which includes flexible feature 106 and flexible feature 108. The body of the first TPA member 100 forms at least one terminal aperture 110.

When the first TPA member 100 is inserted into a connector, it is desirable for the first side to be even, balanced, or in alignment with the second side, so that flexible feature 102 will be engaged with a first tab of the connector at substantially the same time as the flexible feature 106 is engaged with a second tab of the connecter.

When flexible feature 102 engages with a first tab of the connector at substantially the same time as the flexible feature 106 engages with a second tab of the connector, this corresponds to a single peak force. If the first TPA member 100 is inserted into a connector in a lopsided manner, such that flexible feature 102 engages a first tab of the connector before flexible feature 106 engages a second tab of the connector, wherein the first side of the TPA member 100 is inserted into the connector before the second side of the TPA member 100, this can correspond to two or more peak forces, which is not desirable.

Figure 2:
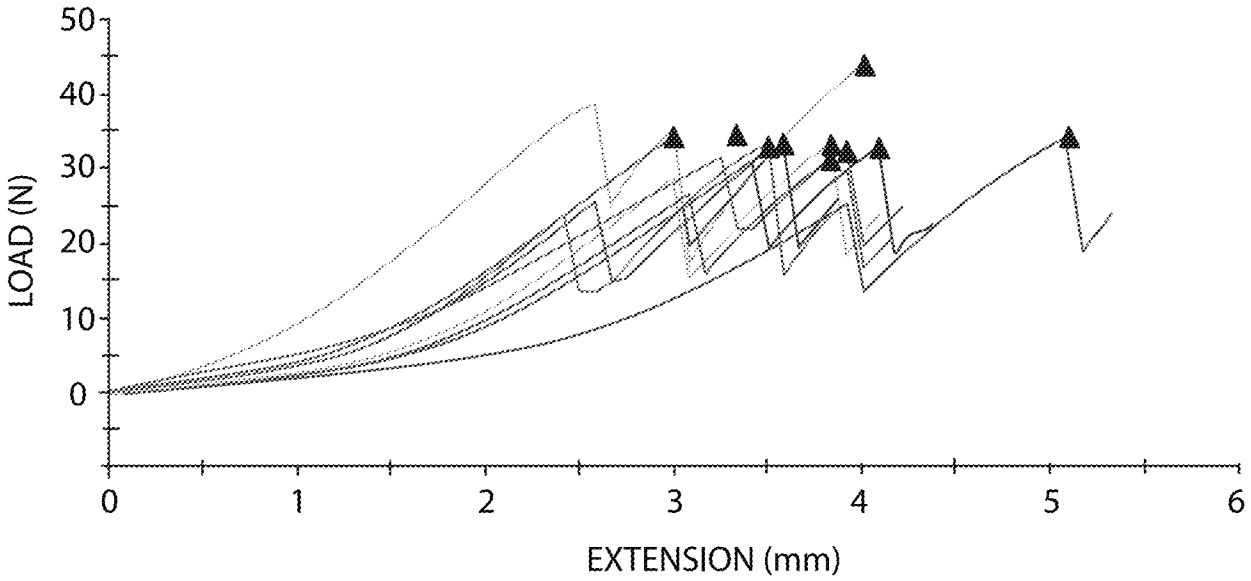
FIG. 2 is a graph showing the forces used to insert the first TPA member of FIG. 1 into a connector.

FIG. 2 is a graph showing the forces used to insert the first TPA member of FIG. 1 into a connector.

FIG. 2 shows the forces used to insert the first TPA member 100 into a connector, or to extract the first TPA member 100 from a connector. The first TPA member 100 does not have locating/guide features 220, 222. Because the first TPA member 100 does not have locating/guide features 220, 222, the flexible feature 102 might be engaged before the flexible feature 106 is engaged. That is, the first TPA member 100 might be inserted into a connector in a lopsided manner, such that one side is inserted before another side.

Because the first TPA member 100 does not have the locating/guide features 220, 222 of the present invention, the first TPA member 100 can be lopsided during insertion and this can lead to an imbalance of force, and the corresponding force curve can have two or more peaks of force. It is desirable to just have one peak of force when a TPA member is inserted into a connector.

In FIG. 2, each different colored curve represents threes from a different sample, when a TPA member that does not have the locating/guide features 220, 222 of the present invention is inserted into a connector. It is easy and common to insert a TPA member in a lopsided manner or uneven manner, when that TPA member does not have the locating/guide features 220, 222 of the present invention.

In FIG. 2, most or all of the different colored curves have two or more peak forces, because it is easy and common to insert a TPA member in a lopsided manner or uneven manner, when that TPA member does not have the locating/guide features 220, 222 of the present invention.

Figure 3:
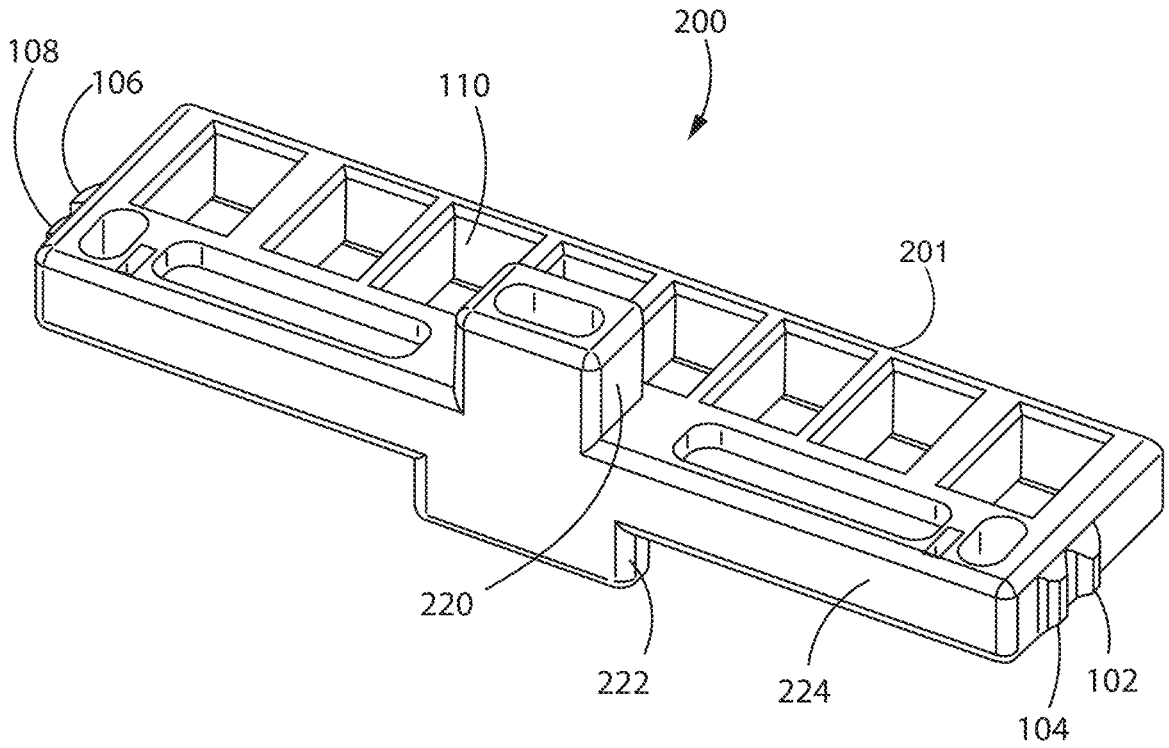
FIG. 3 is a perspective view of a second TPA member that has location/guide features and flexible features, in accordance with the principles of the present invention.

To achieve the maximum force and/or a single peak three during insertion, a TPA member can be configured to have the locating/guide features 220, 222 of the present invention. To achieve the maximum force and/or a single peak force when a TPA member is extracted from a connector, a TPA member can be configured to have the locating/guide features 220, 272 of the present invention. The locating/guide features 220, 222, in a middle area of a TPA member 200 as shown in FIG. 3, help to enable the flexible features 102 and 106 to engage a tab substantially simultaneously. The locating/guide features 220, 222 help to enable the flexible features 104 and 108 engage substantially simultaneously.

The locating/guide features 220, 222 help to have flexible features 102 and 106 engage a connector substantially simultaneously.

FIG. 3 is a perspective view of a second TPA member that has location/guide features and flexible features, in accordance with the principles of the present invention.

FIG. 3 depicts a second TPA member 200 that has a body 201. The body has flexible features 102, 104, 106, and 108 formed thereon. The flexible features 102, 104, 106, and 108 can also be referred to as protrusions 102, 104, 106, and 108 extending outward from sides of the body of the second TPA member 200. FIG. 3 shows that the body of the second TPA member 200 has a top 224. The body also has a location/guide feature 220 extending outward from the body in a first direction, and a location/guide feature 222 extending outward from the body in a second direction opposite to the first direction. The body forms at least one terminal aperture 110. A plurality of terminal apertures 110 are shown in FIG. 3. The flexible features 102, 104, 106, and 108 are more flexible than the location/guide features 220 and 222.

FIG. 3 shows that the location/guide features 220, 222 are at or near a middle area of the top 224, but the location/guide features 220, 222 could be located at one or more different areas of the second TPA member 200, in accordance with the principles of the present invention. One of the purposes of the location/guide features 220, 222 is to help the second TPA member 200 be even and balanced during insertion and extraction, and is not lopsided during insertion or extraction.

Figure 4:
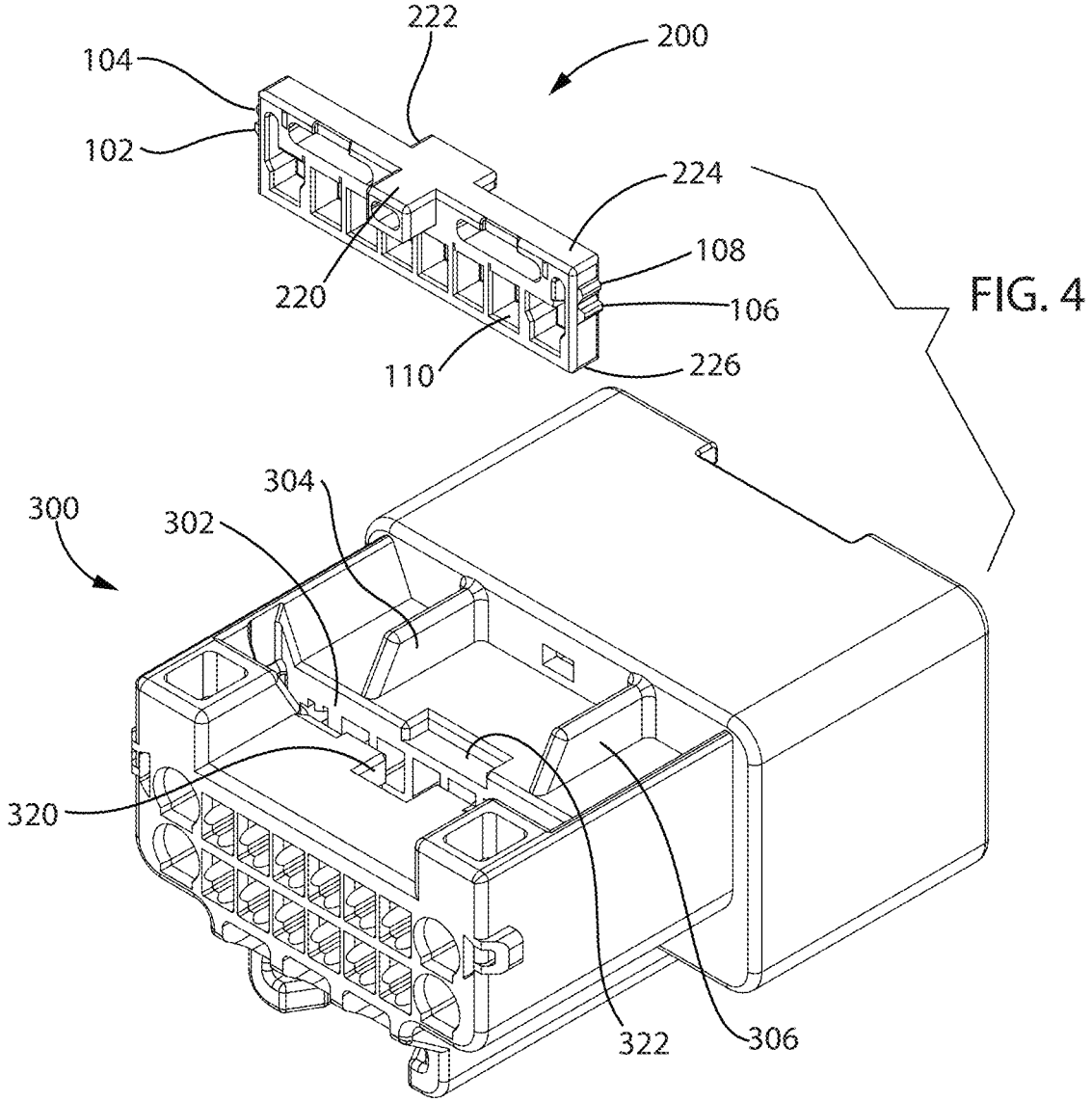
FIG. 4 is an exploded perspective view of the second TPA member of FIG. 3 and a connector, in accordance with the principles of the present invention.

FIG. 4 is an exploded perspective view of the second TPA member of FIG. 3 and a connector, in accordance with the principles of the present invention.

FIG. 4 indicates the top 224 and bottom 226 of the second TPA member 200. FIG. 4 shows a connector 300 which has an aperture 302. The aperture 302 receives the bottom 226 of the second TPA member 200. The connector 300 has ribs 304 and 306.

The location/guide feature 220 extends from the top 224 of the body of the second TPA member 200 in a first direction outward away from the body as shown in FIG. 4, and the location/guide feature 222 extends from the top 224 of the body of the second TPA member 200 in a second direction opposite to the first direction, outward away from the body as shown in FIG. 4.

The location/guide feature 220 also extends downward in a direction toward the bottom 226 of the body of the second TPA member 200, as shown in FIG. 4. The location/guide feature 222 also extends downward in a direction toward the bottom 226 of the body of the second TPA member 200, as shown in FIG. 4.

As shown in FIG. 4, the connector 300 has an aperture 320 for receiving the locating/guide feature 220 of the second TPA member 200. The connector 300 also has an aperture 322 for receiving the locating/guide feature 222 of the second TPA member 200.

Figure 5:
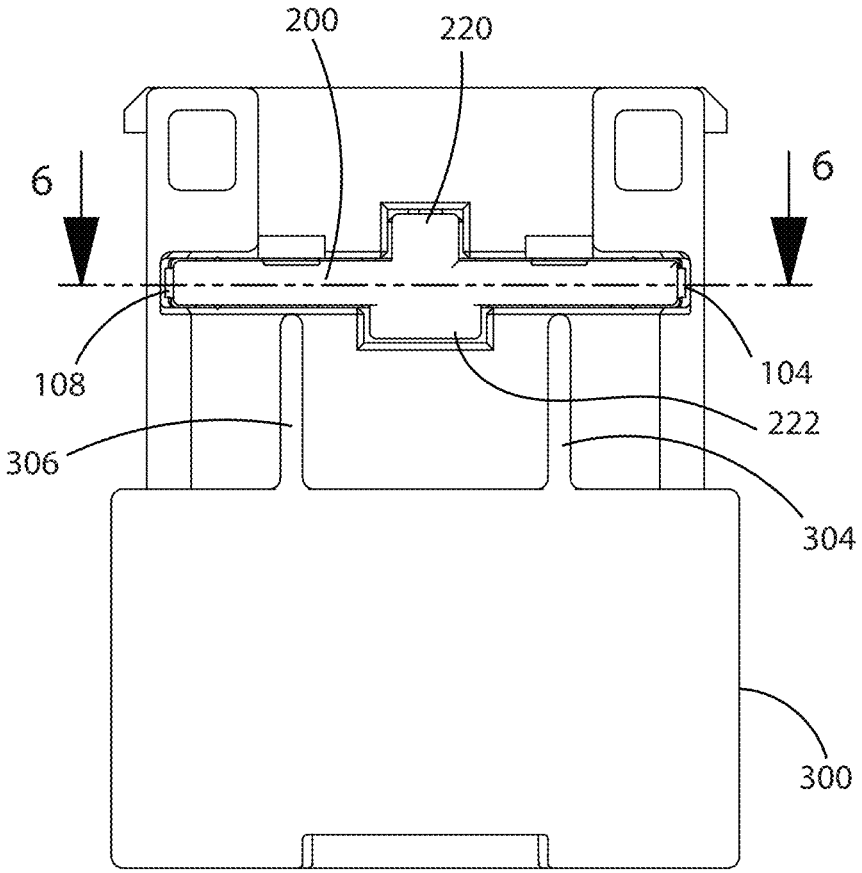
FIG. 5 is an elevational view of the second TPA member of FIG. 4 partially inserted into the connector of FIG. 4, in a preset position, in accordance with the principles of the present invention.

FIG. 5 is an elevational view of the second TPA member of FIG. 4 partially inserted into the connector of FIG. 4, in a preset position, in accordance with the principles of the present invention.

FIG. 5 depicts the preset position, wherein the second TPA member 200 is partially inserted into the aperture 302 of the connector. In the preset position, the flexible features 104 and 108 are visible in FIG. 5, but the flexible features 102 and 106 are not visible in FIG. 5.

Figure 6:
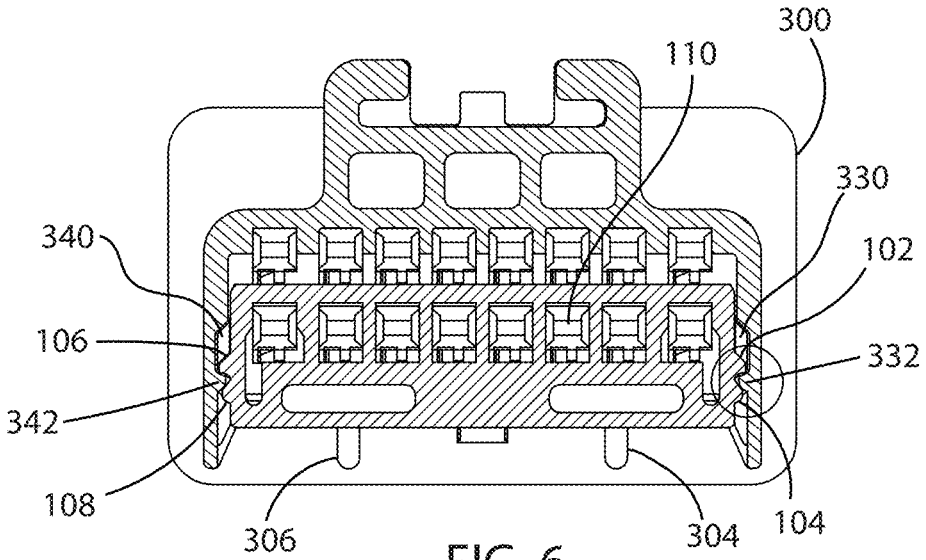
FIG. 6 is a cross-sectional view, taken along line 6-6 in FIG. 5.

FIG. 6 is a cross-sectional view, taken along line 6-6 in FIG. 5.

FIG. 6 depicts the preset position, wherein the second TPA member 200 is partially inserted into the aperture 302 of the connector. FIG. 6 shows that connector 300 forms a receiving area 330 and a tab 332 on an interior of aperture 302, at one side. FIG. 6 also shows that connector 300 forms a receiving area 340 and a tab 342 on an interior of aperture 302, at an opposite side.

When the bottom 226 of the second TPA member 200 is first inserted into the aperture 302, the flexible feature 102 of the second TPA member 200 will engage with the tab 332 of the connector 300, and then the flexible feature 102 will be held in the receiving area 330 by the tab 332, so that the second TPA member 200 is held in the preset position.

When the bottom 226 of the second TPA member 200 is inserted into the aperture 302, the flexible feature 106 of the second TPA member 200 will engage with the tab 342 of the connector 300, and then the flexible feature 106 will be held in the receiving area 340 by the tab 342, so that the second TPA member 200 is held in the preset position.

In the preset position, as shown in FIG. 6, the flexible feature 104 is not in the receiving area 330, and the flexible feature 108 is not in the receiving area 340.

Figure 7:
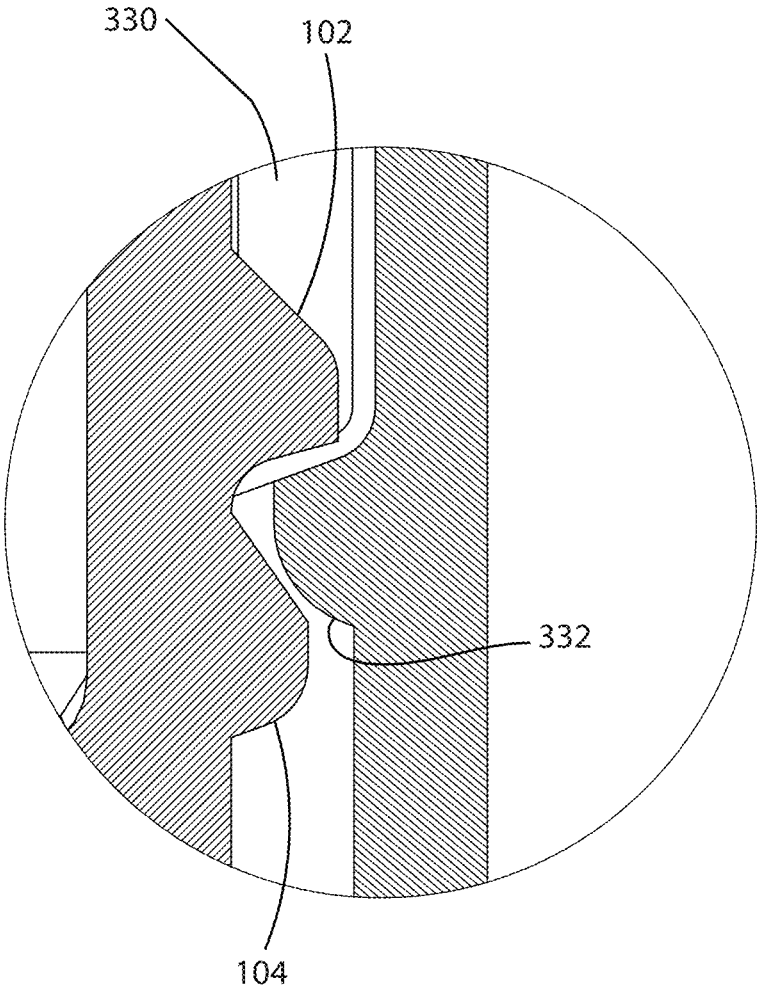
FIG. 7 is an enlarged view of the portion denoted in FIG. 6.

FIG. 7 is an enlarged view of the portion denoted in FIG. 6. The scale of FIG. 7 is 30:1.

Figure 8:
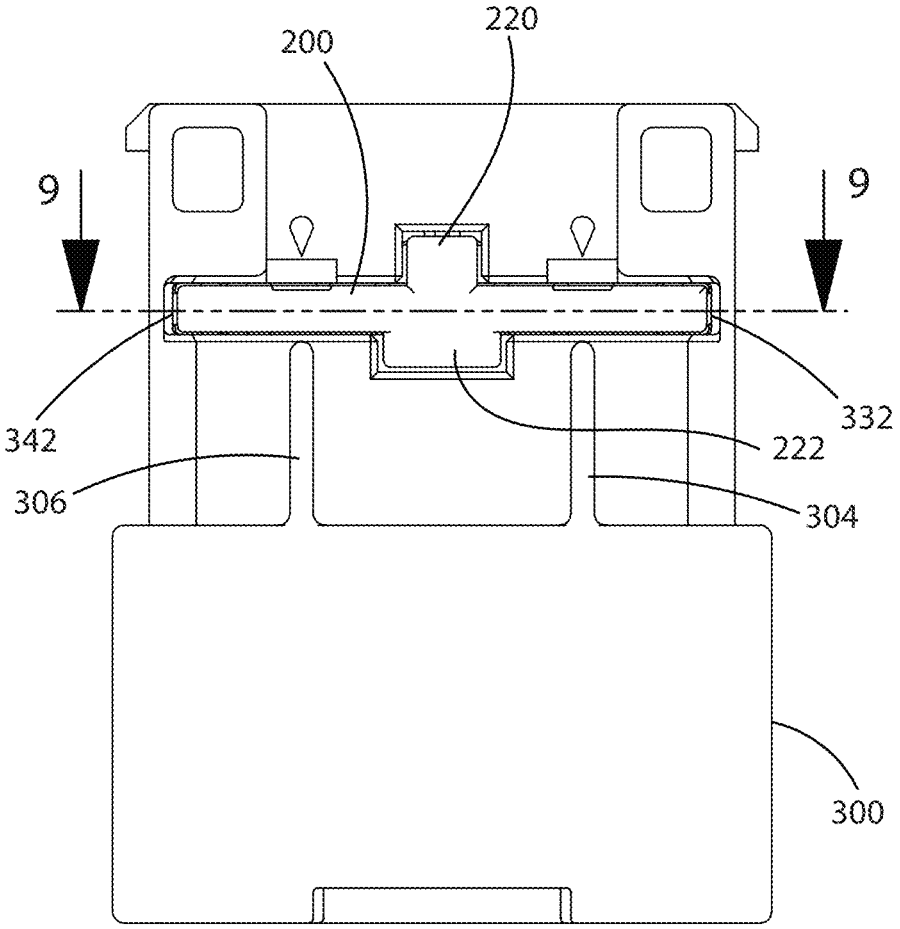
FIG. 8 is an devotional view of the second TPA member of FIG. 4 fully inserted into the connector of FIG. 4, in a final lock position, in accordance with the principles of the present invention.

FIG. 8 is an elevational view of the second TPA member of FIG. 4 fully inserted into the connector of FIG. 4, in a final lock position, in accordance with the principles of the present invention.

FIG. 8 depicts the final lock position, wherein the second TPA member 200 is fully inserted into the aperture 302 of the connector. In the final lock position, the tabs 332 and 342 are visible in FIG. 8, but the flexible features 104 and 108 are not visible in FIG. 8.

Figure 9:
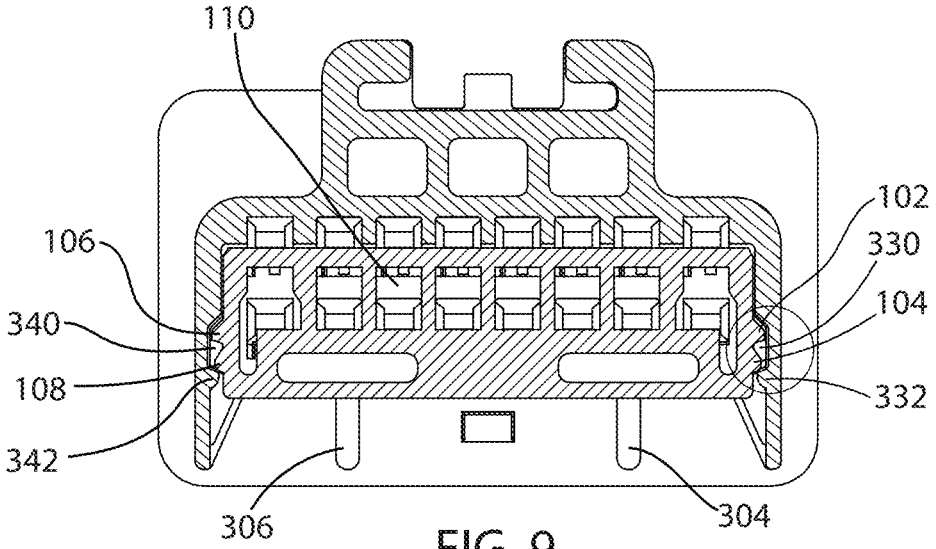
FIG. 9 is a cross-sectional view, taken along line 9-9 in FIG. 8.

FIG. 9 is a cross-sectional view, taken along line 9-9 in FIG. 8.

FIG. 9 depicts the final lock position, wherein the second TPA member 200 is fully inserted into the aperture 302 of the connector. FIG. 9 shows that connector 300 forms a receiving area 330 and a tab 332 on an interior of aperture 302, at one side. FIG. 9 also shows that connector 300 forms a receiving area 340 and a tab 342 on an interior of aperture 302, at an opposite side.

When the second TPA member 200 is moved from the preset position to the final lock position, the flexible feature 104 of the second TPA member 200 will engage with the tab 332 of the connector 300, and then the flexible feature 104 will be held in the receiving area 330 by the tab 332.

When the second TPA member 200 is moved from the preset position to the final lock position, the flexible feature 108 of the second TPA member 200 will engage with the tab 342 of the connector 300, and then the flexible feature 108 will be held in the receiving area 340 by the tab 342.

In the final lock position, as shown in FIG. 9, the flexible features 102 and 104 are both in the receiving area 330, and the flexible features 106 and 108 are both in the receiving area 340.

Figure 10:
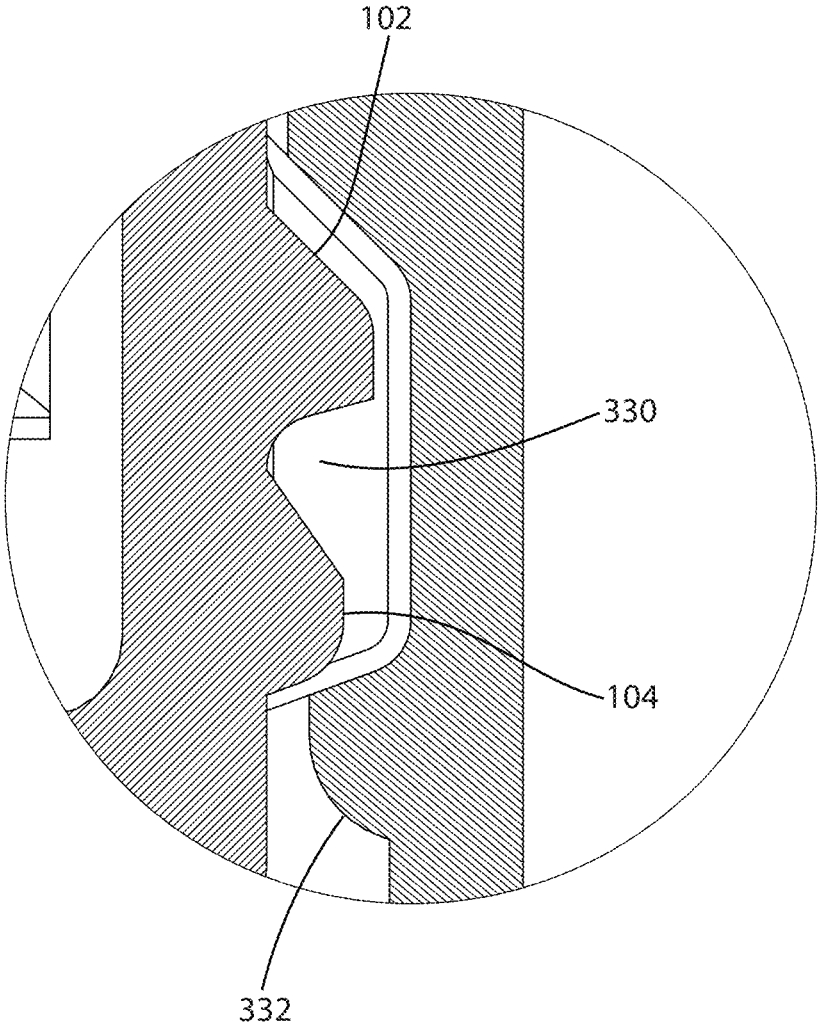
FIG. 10 is an enlarged view of the portion denoted in FIG. 9.

FIG. 10 is an enlarged view of the portion denoted in FIG. 9. The scale of FIG. 10 is 30:1.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Terminal position assurance member
102 Flexible feature (protrusion)
104 Flexible feature (protrusion)
106 Flexible feature (protrusion)
108 Flexible feature (protrusion)
110 Terminal aperture, formed by the body of the terminal position assurance member
200 Terminal position assurance member with locating/guide features
201 Body of the terminal position assurance member
220 Locating/guide feature (guide)
222 Locating/guide feature (guide)
224 Top of body of terminal position assurance member
226 Bottom of body of terminal position assurance member
300 Connector
302 Aperture for receiving bottom of body of terminal position assurance member
304 Rib
306 Rib
320 Aperture for receiving locating/guide feature 220
322 Aperture for receiving locating/guide feature 222
330 Receiving area for receiving flexible features 102 and 104
332 Tab
340 Receiving area for receiving flexible features 106 and 108
342 Tab

We claim:

1. A terminal position assurance member, comprising:

a body;

at least a first guide on a first face of the body and extending a first distance in a first direction away from a central region of the first face of the body;

at least a first protrusion formed directly on a first side surface of the body;

at least a second protrusion on a second side surface of the body, wherein the body has the first face, a second face, the first side surface, the second side surface, a bottom surface, and a top surface, wherein the first side surface extends from the top surface to the bottom surface, wherein the first side surface is a substantially flat and substantially same planar surface at all locations outside of locations of the first protrusion and a third protrusion;

at least a second guide on the second face of the body and extending a second distance in a second direction away from a central region of the second face of the body, the first distance being not equal to the second distance; and at least one terminal aperture formed by the body and extending through the body in the first direction from the second face to the first face, wherein the first guide has an upper surface extending in the first direction from the top surface of the body, wherein the first protrusion extends from an edge of the first face to an edge of the second face, wherein the first side surface is a substantially solid surface without forming a slit in a third direction from the top surface to the bottom surface.

2. The terminal position assurance member of claim 1, wherein the second direction is opposite to the first direction.

3. The terminal position assurance member of claim 1, wherein the third protrusion is on the first side surface of the body, and the first and third protrusions are formed parallel to each other on the first side surface of the body.

4. The terminal position assurance member of claim 3, further comprising:

a fourth protrusion on the second side surface of the body.

5. The terminal position assurance member of claim 4, wherein at least the first and second protrusions are flexible features.

6. The terminal position assurance member of claim 1, wherein the first guide is less flexible than the first and second protrusions.

7. The terminal position assurance member of claim 1, further comprising:

the third protrusion on the first side surface of the body being formed parallel to the first protrusion; and a fourth protrusion on the second side surface of the body, wherein the first guide has a first shape and the second guide has a second shape different from the first shape.

8. The terminal position assurance member of claim 7, wherein at least the first protrusion is more flexible than the first guide.

9. The terminal position assurance member of claim 7, wherein at least the second protrusion is more flexible than the second guide.

10. A method of operating a terminal position assurance member, comprising:

inserting a bottom surface of a body of a terminal position assurance member into a first aperture formed by a connector;

causing a first guide, formed on a central region of a first face of the body of the terminal position assurance member, to be at least partly received by a second aperture formed by the connector, causing a second guide, formed on a central region of a second face of the body of the terminal position assurance member, to be at least partly received by a third aperture formed by the connector, wherein the body has the first face, the second face, a first side, a second side, a top surface and the bottom surface, wherein the first guide extends a first distance in a first direction away from the first face of the body, wherein the second guide extends a second distance, wherein the body forms at least one terminal aperture which extends through the body in the first direction from the second face to the first face, wherein the first guide has an upper surface extending in the first direction from the top surface of the body, wherein a first protrusion is formed directly on the first side to extend from an edge of the first face to an edge of the second face, wherein the first side extends from the top surface to the bottom surface, wherein the first side surface is a substantially flat and substantially same planar surface at all locations outside of locations of the first protrusion and a third protrusion, wherein the first side surface is a substantially solid surface without forming a slit in a third direction from the top surface to the bottom surface.

11. The method of claim 10, further comprising:

engaging the first protrusion on the first side of the body of the terminal position assurance member with a first tab formed in the first aperture of the connector; and then receiving the first protrusion in a first receiving area formed adjacent to the first tab.

12. The method of claim 11, further comprising:

engaging a second protrusion on the second side of the body of the terminal position assurance member with a second tab formed in the first aperture of the connector, and then receiving the second protrusion in a second receiving area formed adjacent to the second tab, wherein the first side is opposite to the second side.

13. The method of claim 12, wherein the first protrusion engages with the first tab at substantially the same time as the second protrusion engages with the second tab.

14. The method of claim 13, wherein the first protrusion engages with the first tab at substantially the same time as the second protrusion engages with the second tab because the first guide, being at least partly in the second aperture, guides an alignment of the terminal position assurance member so that the first side is aligned with the second side.

15. The method of claim 12, wherein when the first protrusion is received in the first receiving area and the second protrusion is received in the second receiving area, the third protrusion on the first side of the body of the terminal position assurance member is not received in the first receiving area and a fourth protrusion on the second side of the body of the terminal position assurance member is not received in the second receiving area.

16. The method of claim 15, wherein when the first protrusion is received in the first receiving area, the second protrusion is received in the second receiving area, the third protrusion is not received in the first receiving area, and the fourth protrusion is not received in the second receiving area, the terminal position assurance member is in a preset position.

17. The method of claim 16, further comprising:

engaging the third protrusion with the first tab formed in the first aperture of the connector;

engaging the fourth protrusion with the second tab formed in the first aperture of the connector; and then receiving the third protrusion in the first receiving area and receiving the fourth protrusion in the second receiving area.

18. The method of claim 17, wherein when the first and third protrusions are received in the first receiving area, and the second and fourth protrusions are received in the second receiving area, the terminal position assurance member is in a final lock position.

19. A terminal position assurance member, comprising:

a body having a first face, a second face, a first side surface, a second side surface, a top surface, and a bottom surface;

a first guide on the first face of the body and extending a first distance in a first direction away from a central region of the first face of the body;

a second guide on the second face of the body and extending a second distance in a second direction away from a central region of the second face of the body, the second direction being opposite to the first direction, the first distance being not equal to the second distance;

a first pair of protrusions formed directly on the first side surface of the body;

a second pair of protrusions on the second side surface of the body; and at least one terminal aperture formed by the body and extending through the body in the first direction from the second face to the first face, wherein the first guide has an upper surface extending in the first direction from the top surface of the body, wherein the first pair of protrusions is arranged in a parallel configuration and extends from an edge of the first face to an edge of the second face, wherein the first side surface extends from the top surface to the bottom surface, wherein the first side surface is a substantially flat and substantially same planar surface at all locations outside of location of the first pair of protrusions, wherein the first side surface is a substantially solid surface without forming a slit in a third direction from the top surface to the bottom surface.

20. The terminal position assurance member of claim 19, wherein the first and second guides extend from the top surface of the terminal position assurance member to be received by apertures formed by a connector housing.

21. A connector, comprising:

a body having a first surface and a wall; and at least two ribs formed on the first surface, including a first rib and a second rib, wherein the first rib has a first edge surface and a second edge surface, wherein at least a first aperture is formed in the first surface, wherein the two ribs are formed directly from an edge of the first aperture, wherein the first edge surface extends from the edge of the first aperture to the second edge surface, is in contact with the edge of the first aperture, is in contact with the second edge surface, is not perpendicular to the first surface, and is not in contact with the wall, and wherein the second edge surface extends from the first edge surface to the wall, is not in contact with the edge of the first aperture, is in contact with the first edge surface, is substantially parallel to the first surface, and is in contact with the wall.

22. The connector of claim 21, wherein the first rib is spaced apart from the second rib.

23. The connector of claim 21, wherein at least a second aperture is formed in the first surface.

* * * * *